US007099604B2

(12) United States Patent
Nishimoto et al.

(10) Patent No.: US 7,099,604 B2
(45) Date of Patent: Aug. 29, 2006

(54) IMAGE FORMING APPARATUS

(75) Inventors: Yoshio Nishimoto, Kyoto (JP); Yoshinori Nakahira, Tenri (JP); Yusuke Nagano, Yamatokoriyama (JP); Yoshifumi Maitani, Nara (JP); Kazuya Iwabayashi, Tenri (JP); Kenichi Morimoto, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/974,911

(22) Filed: Oct. 28, 2004

(65) Prior Publication Data

US 2005/0094180 A1 May 5, 2005

(30) Foreign Application Priority Data

Oct. 31, 2003 (JP) ..... 2003-373262

(51) Int. Cl.
*G03G 15/00* (2006.01)

(52) U.S. Cl. ..... 399/88; 399/8; 399/37; 358/1.13; 358/1.14

(58) Field of Classification Search ..... 399/88, 399/37, 8

See application file for complete search history.

(56) References Cited

U.S. PATENT DOCUMENTS 4,745,436 A * 5/1988 Matsuura ..... 399/70
6,134,401 A * 10/2000 Yun et al. ..... 399/70
6,166,355 A * 12/2000 Watanabe et al. ..... 219/497
6,181,895 B1 * 1/2001 Hirst ..... 399/88
6,674,980 B1 * 1/2004 Nakaya ..... 399/69
2004/0107371 A1 * 6/2004 Kimura et al. ..... 713/300

FOREIGN PATENT DOCUMENTS

JP 1-277915 A 11/1989
JP 4-67733 A 3/1992
JP 8-63051 A 3/1996
JP 2001-094693 A 4/2001
JP 2002-094690 A 3/2002
JP 2003-039794 A 2/2003
JP 2003-228444 A 8/2003

* cited by examiner

*Primary Examiner*—David M. Gray
*Assistant Examiner*—Ryan D. Walsh
(74) *Attorney, Agent, or Firm*—Birch, Stewart, Kolasch, & Birch, LLP

(57) ABSTRACT

A multi-function printer (MFP) has a main control circuit for setting the operation mode of the apparatus to either a normal operation mode or a power-saving operation mode. There are provided a main power supply circuit and an auxiliary power supply circuit for supplying power to the main control circuit in the normal operation mode and in the power-saving operation mode, respectively. The MFP also has a power detection circuit for detecting a state of power supply from the main power supply circuit to the main control circuit. If a power-save request is followed by a start-up request, when an amount of power detected by the power detection circuit is greater than a predetermined value, the main control circuit stops an operation relating to the power-save request and initiates an operation according to a start-up request.

16 Claims, 14 Drawing Sheets

IMAGE FORMING APPARATUS

CROSS REFERENCE

This Nonprovisional application claims priority under 35 U.S.C. § 119(a) on Patent Application No. 2003-373262 filed in Japan on Oct. 31, 2003, the entire contents of which are hereby incorporated by reference.

BACKGROUND OF THE INVENTION

The present invention relates to an image forming apparatus for image formation in accordance with input image data, and particularly to an image forming apparatus having a power-saving operation mode.

In image forming apparatuses such as a printer or a copying machine, attention has been focused on reducing standby power consumption to a minimum level. One known solution is to incorporate a power supply device that stops power supply from a main power supply circuit during standby time.

However, an image forming apparatus on standby is sometimes required to return to a normal operation mode in response to external input signals. During standby time, a copying machine with facsimile functions, for example, needs to be ready to appropriately receive facsimile data input externally over telephone lines. A printer needs to return to a normal operation mode immediately on detection of image data input from a personal computer and perform an image forming operation according to the input image data.

Japanese Patent Application Laid-Open No. 2001-94693 discloses an image forming apparatus capable of returning from a power-saving operation mode to a normal operation mode appropriately as necessary.

The image forming apparatus, however, switches between the two operation modes regardless of a state of power supply from a main power supply to different components of the apparatus. Accordingly, switching of the operation modes cannot be optimized according to the power supply conditions, thereby taking excessive time.

A feature of the present invention is to offer an image forming apparatus that is ready to receive external signals with minimum power consumption in a power-saving operation mode.

Another feature of the present invention is to offer an image forming apparatus capable of switching between operation modes in a short time.

SUMMARY OF THE INVENTION

An image forming apparatus of the present invention has a control section for switching the apparatus between a normal operation mode and a power-saving operation mode. When a power-save request is immediately followed by a start-up request, the control section omits initialization operations and directly sets about performing an operation according to the start-up request. The initialization operations include input/output port initialization, memory initialization, display initialization, and initialization of communication board as an interface. In conventional image forming apparatuses, such initialization operations are normally performed when a start-up request for returning to a normal operation mode is made.

The image forming apparatus of the present invention, in contrast, omits the initialize operations and directly performs the operation according to a start-up request if sufficient power is supplied from a main power supply circuit to the control section when the start-up request is made. This is based on an idea that with a lower voltage applied to the control section after a power-save request is made, the image forming apparatus does not malfunction without the initialize operations if the lower voltage is equal to or higher than a voltage sufficient for proper operation of the control section. The omission of initialize operations allows the image forming apparatus to return to the normal operation mode in a short time.

DETAILED DESCRIPTION OF THE INVENTION

Figure 1:
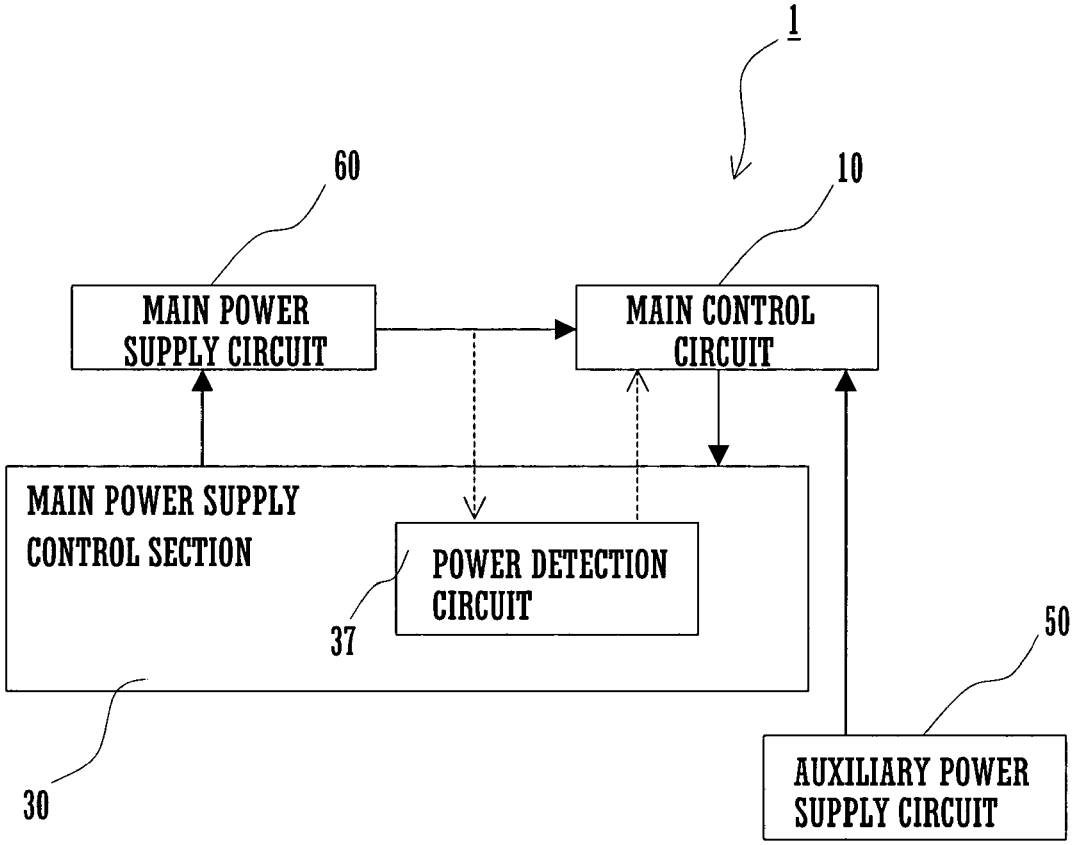
FIG. 1 is a schematic block diagram of the present invention.

Referring to the drawings, described below is a multifunction printer (hereinafter merely as MFP) 1 according to a first embodiment of the present invention. As shown in FIG. 1, the MFP 1 has a main control circuit 10, a main power supply circuit 60, an auxiliary power supply circuit 50, and a main power supply control section 30.

The main control circuit 10 sets the MFP 1 to either a normal operation mode or a power-saving operation mode. In the normal operation mode, the MFP 1 operates normally, and in the power-saving operation mode, the MFP operates with minimum power consumption. The main control circuit 10 has overall control of operations of each of the components of the MFP 1. The main power supply circuit 60 supplies power to each of the components including the main control circuit 10 in the normal operation mode. The auxiliary power supply circuit 50 supplies power to the main control circuit 10 in the power-saving operation mode.

The main power supply control section 30 has a plurality of circuits for controlling stop and start-up of the main power supply circuit 60. The plurality of circuits include a power detection circuit 37 and a circuit for detecting an external signal. In the normal operation mode, the main power supply control section 30 stops the main power supply circuit 60 in accordance with a power-save request from the main control circuit 10. In the power-saving operation mode, the main power supply control section 30 restarts the main power supply circuit 60 in accordance with an input external signal.

The power detection circuit 37 detects a state of power supply from the main power supply circuit 60 to the main control circuit 10. In the present embodiment, the power detection circuit 37 monitors an amount of power supplied from the main power supply circuit 60 to the main control circuit 10, and in particular an amount of voltage applied to the main control circuit 10. The power detection circuit 37 transmits a signal according to the amount of voltage as detected, to the main control circuit 10.

In switching to the power-saving operation mode, the main control circuit 10 transmits a power-save request to the main power supply circuit 30. The main power supply control section 30 stops operations of the main power supply circuit 60 in response to the power-save request. When detecting an external signal as a start-up request after receiving a power-save request, the main power supply control section 30 restarts the main power supply circuit 60.

A feature of the present invention is a process in which the main power supply control section 30 restarts the main power supply circuit 60. When restarting the main power supply circuit 60 immediately after receiving the power-save request, the main power supply control section 30 determines whether an amount of power detected by the power detection circuit 37 is greater than a predetermined value. If the amount of power is greater than the predetermined value, the main power supply control section 30 stops an operation according to the power-save request and starts an operation according to the start-up request without the initialize operations performed. In the MFP 1 in the power-saving operation mode, the initialize operations are thus omitted when sufficient power for ensuring the operation of the main control circuit 10 is supplied from the main power supply circuit 60 to the main control circuit 10. This allows the operation modes to be switched in a short time. The first embodiment of the present invention is described in detail below.

Figure 2:
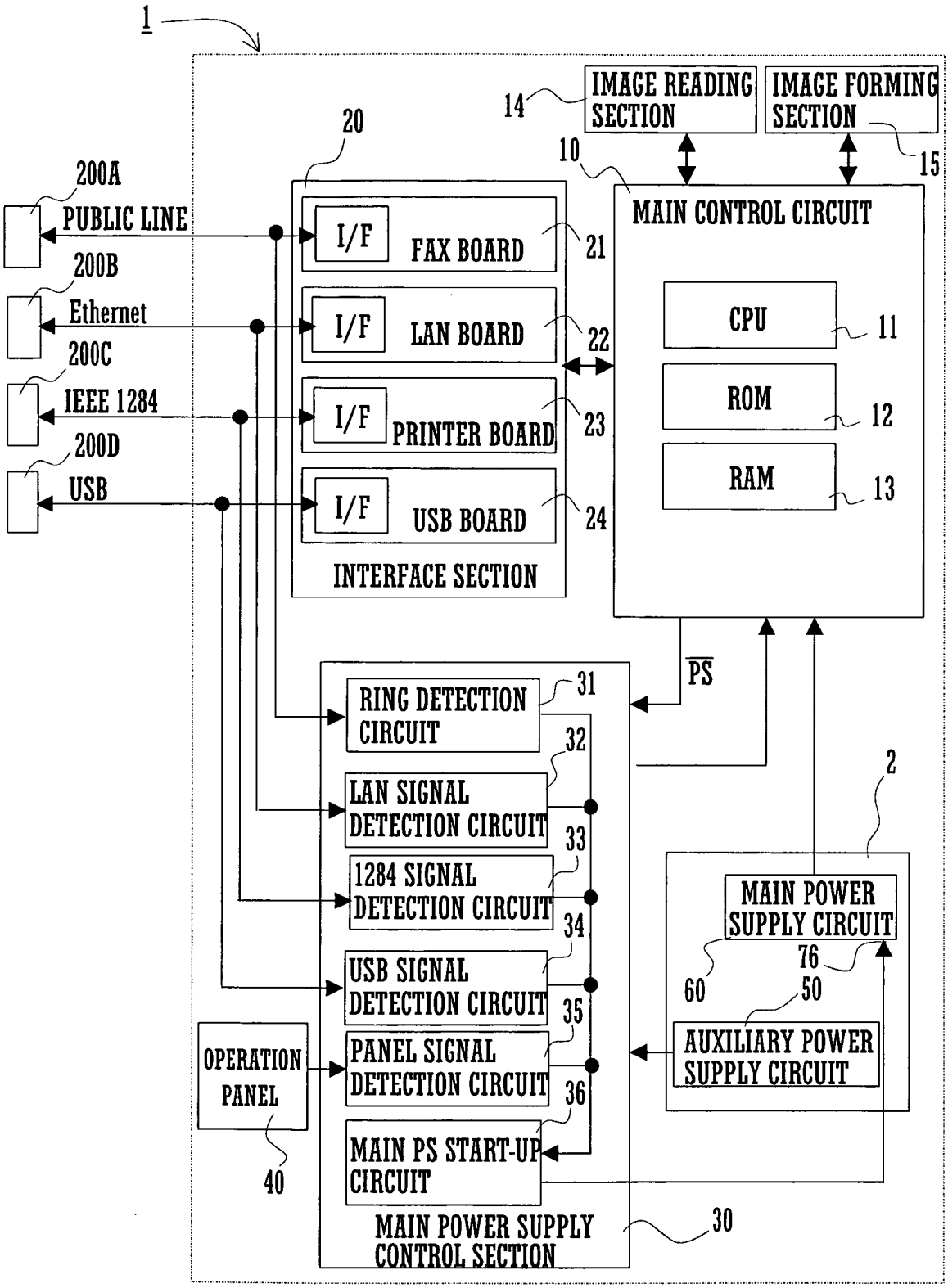
FIG. 2 is a block diagram illustrating a configuration of an image forming apparatus according to a first embodiment of the present invention.

As shown in FIG. 2, the MFP 1 has a power supply section 2, the main power supply control section 30, the main control circuit 10, an interface section 20, an image reading section 14, an image forming section 15, and an operation panel 40.

The image reading section 14 utilizes an optical unit to scan an image of an original placed on a not-shown original platen. The image forming section 15 performs an image forming operation according to image data input through the main control circuit 10.

The interface section 20 is utilized for communication between the MFP 1 and external devices 200A to 200D. In the present embodiment, commands from the external devices 200A to 200D are input to the image forming section 15 through the interface section 20. The interface section 20 has a FAX board 21, a LAN board 22, a printer board 23 and a USB board 24.

The FAX board 21 is used for communication of FAX data input and output through a public line. The LAN board 22 is used for data communication over Ethernet within a local area network ("Ethernet" is a trademark). The printer board 23 is used for communication with an external personal computer through an IEEE 1284 interface. The USB board 24 is used for communication with a USB device, such as a digital camera or an image storage device, through a USB interface.

The main power supply control section 30 has a ring detection circuit 31, a LAN signal detection circuit 32, a 1284 signal detection circuit 33, a USB signal detection circuit 34, a panel signal detection circuit 35, and a main power supply start-up circuit 36. The ring detection circuit 31 detects FAX data received through the public line. The LAN signal detection circuit 32 detects input of communication data over Ethernet within the local area network. The 1284 signal detection circuit 33 detects a signal input from the external device 200C through the IEEE 1284 interface. The USB signal detection circuit 24 detects a signal input from the external device 200D through the USB interface. The panel signal detection circuit 35 detects whether a button on the operation panel 40 is pressed by a user. The main power supply start-up circuit 36 controls on/off of the main power supply circuit 60 in accordance with the signals input from the circuits 31 to 35 and from the main control circuit 10.

The operation panel 40 is used for a user to input commands to the image forming section 15. The commands include: a command for returning the MFP 1 in the power-saving mode to the normal operation mode; a command for copying an original with the image reading section 14; a command for setting print magnification and the number of print copies for the image forming section 15; a command for confirming a job status or a FAX destination number; and a command for checking how much toner is remaining.

The power supply section 2 includes the auxiliary power supply circuit 50 and the main power supply circuit 60. In the power-saving operation mode, the auxiliary power supply circuit 50 supplies power to the main power supply control section 30. In the normal operation mode, the main power supply circuit 60 supplies a predetermined amount of power to components of the MFP 1 including the main control circuit 10.

The main control circuit 10 having a CPU 11, a ROM 12, and a RAM 11 has overall control of operation of each of the components of the MFP 1. The main control circuit 10 is connected to each of the power supply section 2, the main power supply control section 30, the interface section 20, the image reading section 14, the image forming section 15 and the operation panel 40. When stopping the main power supply circuit 60, the main control circuit 10 outputs a $\overline{PS}$ signal (to be described later) to the main power supply control section 30. In the present embodiment, the main control circuit 10 corresponds to the control section of the present invention.

With no command received for more than a predetermined period of time, the main control circuit 10 switches to the power-saving operation mode to reduce standby power consumption. In the power-saving operation mode, the main power supply circuit 60 supplies no power to each component of the MFP 1 until the next command is input. Upon detection of an input start-up signal, the MFP 1 returns to the normal operation mode, and the main power supply circuit 60 restarts supplying power to each component of the MFP 1 including the main control circuit 10.

Figure 3:
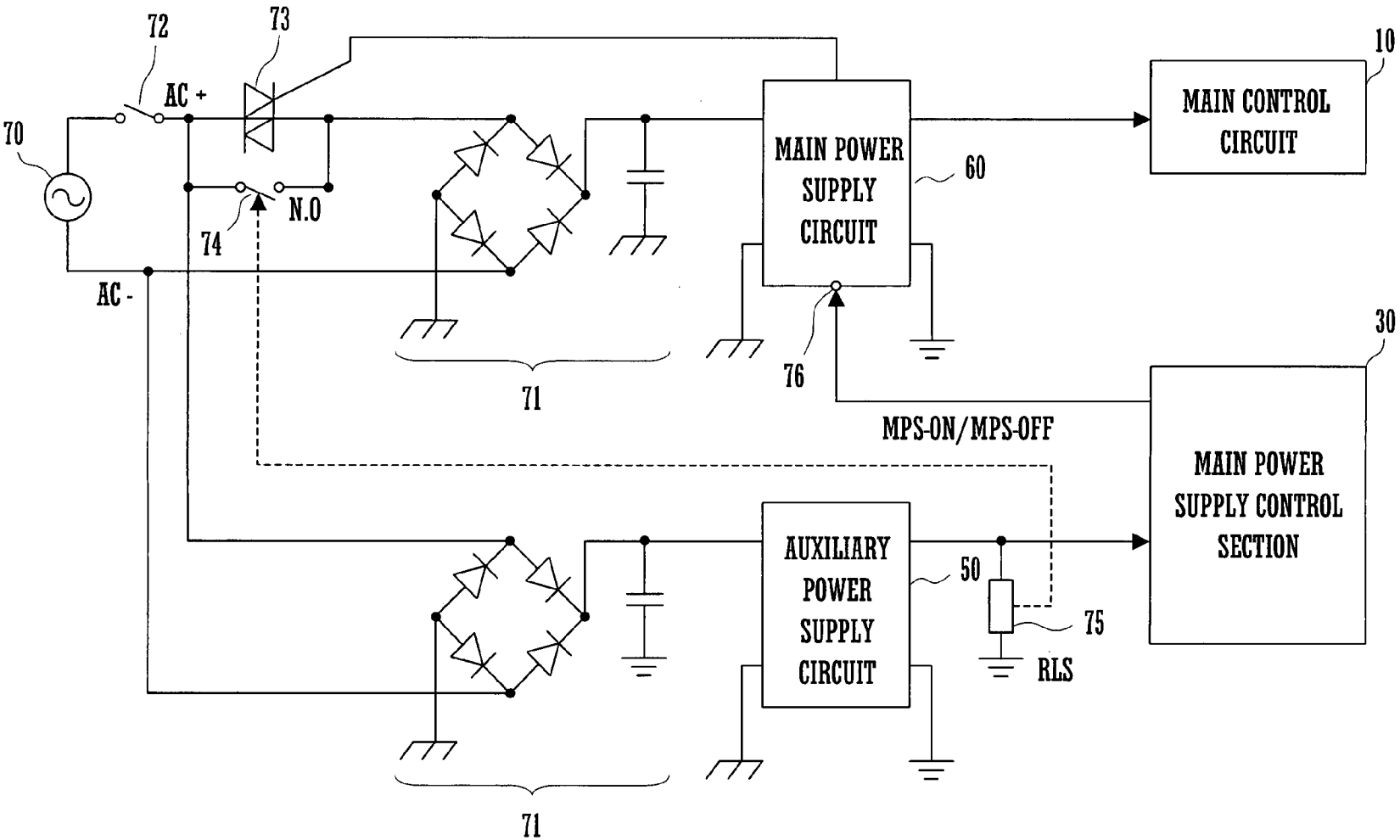
FIG. 3 is a diagram illustrating a configuration of a power supply circuit of the image forming apparatus.

As shown in FIG. 3, a commercial power supply 70 is connected to the auxiliary power supply circuit 50 through a main switch 72 and a smoothing circuit 71. The main switch 72 is a switch for switching on/off the main power supply of the MFP 1. The smoothing circuit 71 provided for rectification and smoothing has a diode bridge and a capacitor. The auxiliary power supply circuit 50 is connected to a grounded relay coil 75 and the main power supply control section 30, respectively. The commercial power supply 70 is also connected to the main power supply circuit 60 through the main switch 72, a triac 73, a relay contact 74, and a smoothing circuit 71. A gate of the triac 73 is connected to the main power supply circuit 60. The relay contact 74 is a normally open relay contact that is switched open/closed by the relay coil 75. The triac 73 and the relay contact 74, connected in parallel, are both connected to the main switch 72 and the smoothing circuit 71.

The main power supply circuit 60 is provided with an MPS signal input terminal 76. To the MPS signal input terminal 76, a low-level signal to switch on the main power supply circuit 60, or an MPS-ON signal, and a signal to switch off the main power supply circuit 60, or an MPS-OFF signal, are input selectively. The main power supply circuit 60 is connected to the gate of the triac 73 and the main control circuit 10, respectively.

Described below is how the MFP 1 operates. The MFP 1 is activated by turning on the main switch 72. In the activation process, current flows from the commercial power supply 70 to the auxiliary power supply circuit 50 through the smoothing circuit 71. Then, the auxiliary power supply circuit 50 supplies power to the relay coil 75. Current flowing through the relay coil 75 causes the relay contact 74 to be closed, thereby allowing current flow from the commercial power supply 70 to the main power supply circuit 60 through the relay contact 74 and the smoothing circuit 71.

Subsequently, the main power supply circuit 60 starts to supply power to the gate of the triac 73, thereby allowing the triac 73 to become conductive. The main power supply circuit 60 also starts to supply power to the main control circuit 10, thereby allowing the MFP 1 to initiate operations.

Figure 4:
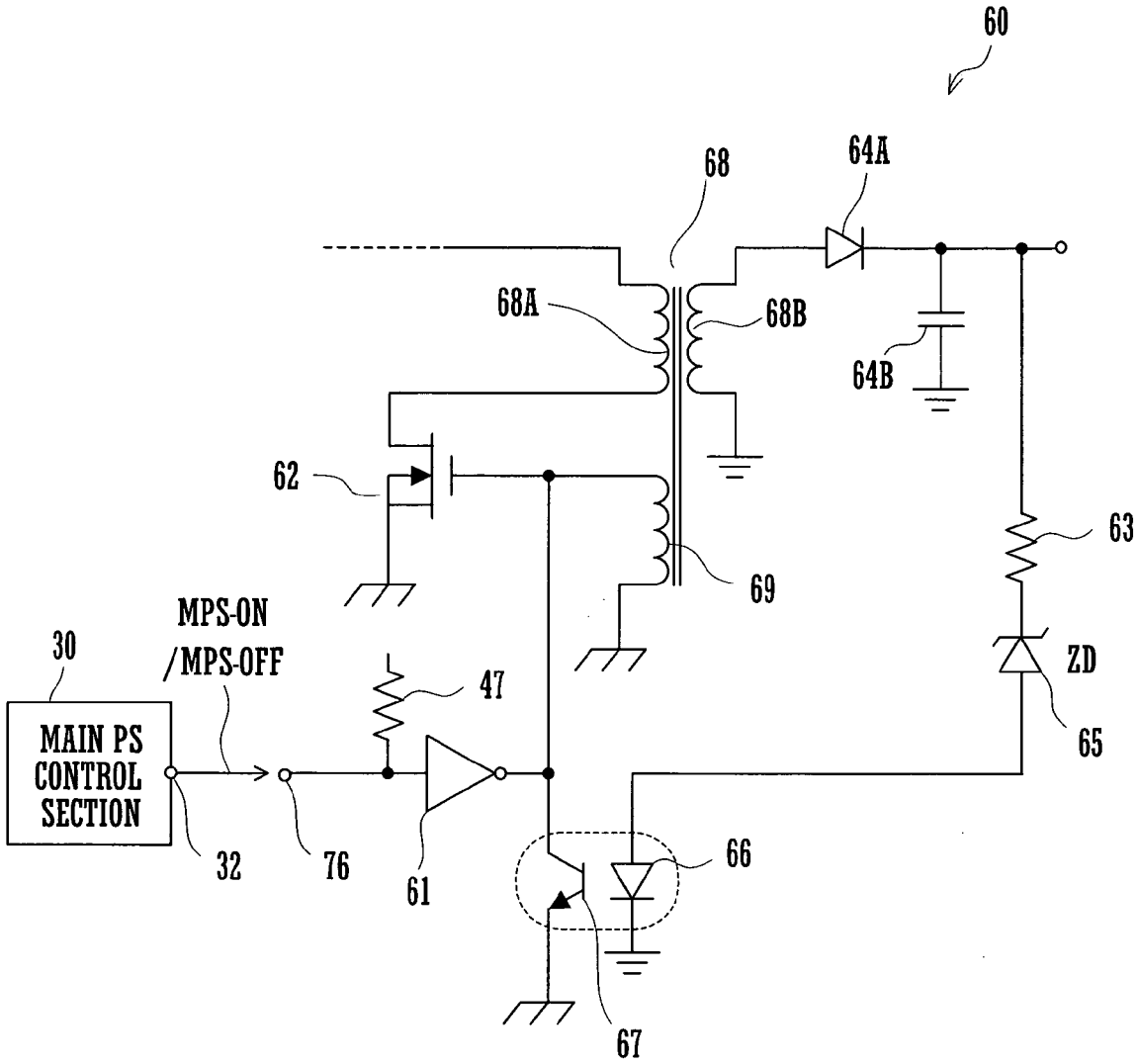
FIG. 4 is a diagram illustrating a configuration of principal parts of a main power supply circuit of the image forming apparatus.

As shown in FIG. 4, the main power supply circuit 60 is provided with a switching transformer having a first primary winding 68A, a second primary winding 69, and a secondary winding 68B. The first primary winding 68A is connected to the smoothing circuit 71 and a switching transistor 62. The secondary winding 68B is connected to an anode of a diode 64A, and a cathode of the diode 64A is connected to a grounded capacitor 64B and a power supply terminal.

A connection midway between the capacitor 64B and the power supply terminal is grounded through a resistor 63, a zener diode 65, and a light-emitting diode 66.

A gate of the switching transistor 62 is connected to the second primary winding 69 and a phototransistor 67 with a grounded emitter. A collector of the phototransistor 67 is connected to the MPS signal input terminal 76 through an inverter (open-collector) 61. A connection midway between the MPS signal input terminal 76 and the inverter 61 is connected to the auxiliary power supply circuit 50 through a pull-up resistor 47.

When an MPS-ON signal is input to the MPS signal input terminal 76, output of the inverter (open-collector) 61 is put in a high-impedance state, thereby causing the gate of the switching transistor 62 to become ungrounded. A valid feedback signal is thus input to the gate of the switching transistor 62 from the first primary winding 68A, thereby causing switching oscillation. The switching oscillation allows power supply from the secondary winding 68B to the main control circuit 10 through the power supply terminal.

When potential at the connection midway between the capacitor 64B and the power supply terminal reaches a predetermined value, current flows to the light-emitting diode 66 through the resistor 63 and the zener diode 65. Thus, the phototransistor 67 is turned on and the gate of the switching transistor 62 is forced to be grounded, thereby stopping the switching oscillation of the switching transformer. The switching on/off of switching oscillation allows sufficient power to be supplied from the main power supply circuit 60 to the main control circuit 10.

When potential at the connection midway between the capacitor 64B and the power supply terminal reaches a predetermined value, current flows to the light-emitting diode 66 through the resistor 63 and the zener diode 65. Thus, the phototransistor 67 is turned on and the gate of the switching transistor 62 is forced to be grounded, thereby stopping the switching oscillation of the switching transformer. The switching on/off of switching oscillation allows sufficient power to be supplied from the main power supply circuit 60 to the main control circuit 10.

When an MPS-OFF signal is input to the MPS signal input terminal 76, in contrast, the gate of the switching transistor 62 is forced to be grounded. Switching oscillation of the switching transformer is thus stopped.

For example, when an MPS-OFF signal is input from the main power supply control section 30 to the MPS signal input terminal 76 in the normal operation mode, switching oscillation of the switching transformer is stopped. When an MPS-ON signal is input from the main power supply control section 30 to the MPS signal input terminal 76 in the power-saving operation mode, switching oscillation of the switching transformer is initiated.

The main power supply control section 30 outputs either an MPS-ON signal or an MPS-OFF signal to the MPS signal input terminal 76 according to the operation mode of the MFP 1. With no command input to the MFP 1 for more than a predetermined time, the main control circuit 10 outputs a power-save request signal to the main power supply control section 30. Upon receipt of the valid power-save request signal, the main power supply control section 30 outputs an MPS-OFF signal to the MPS signal input terminal 76.

Figure 5A:
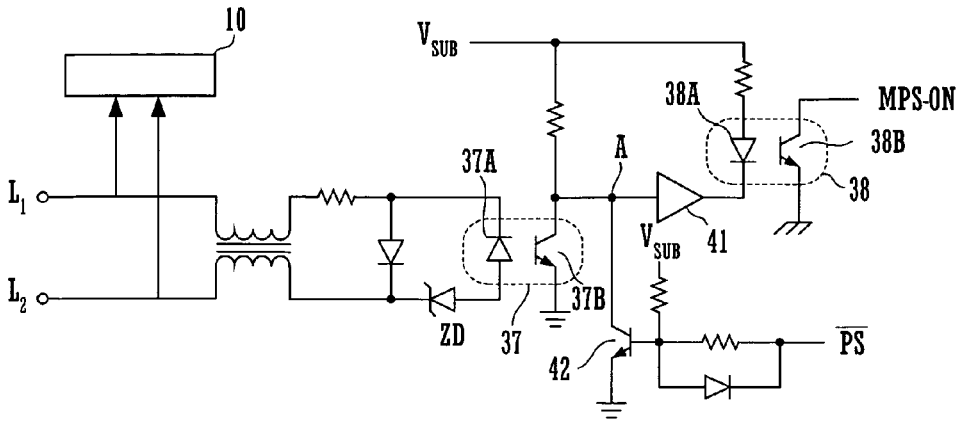
FIGS. 5A and 5B are diagrams illustrating a configuration of principal parts of a main power supply control section.
Figure 5B:
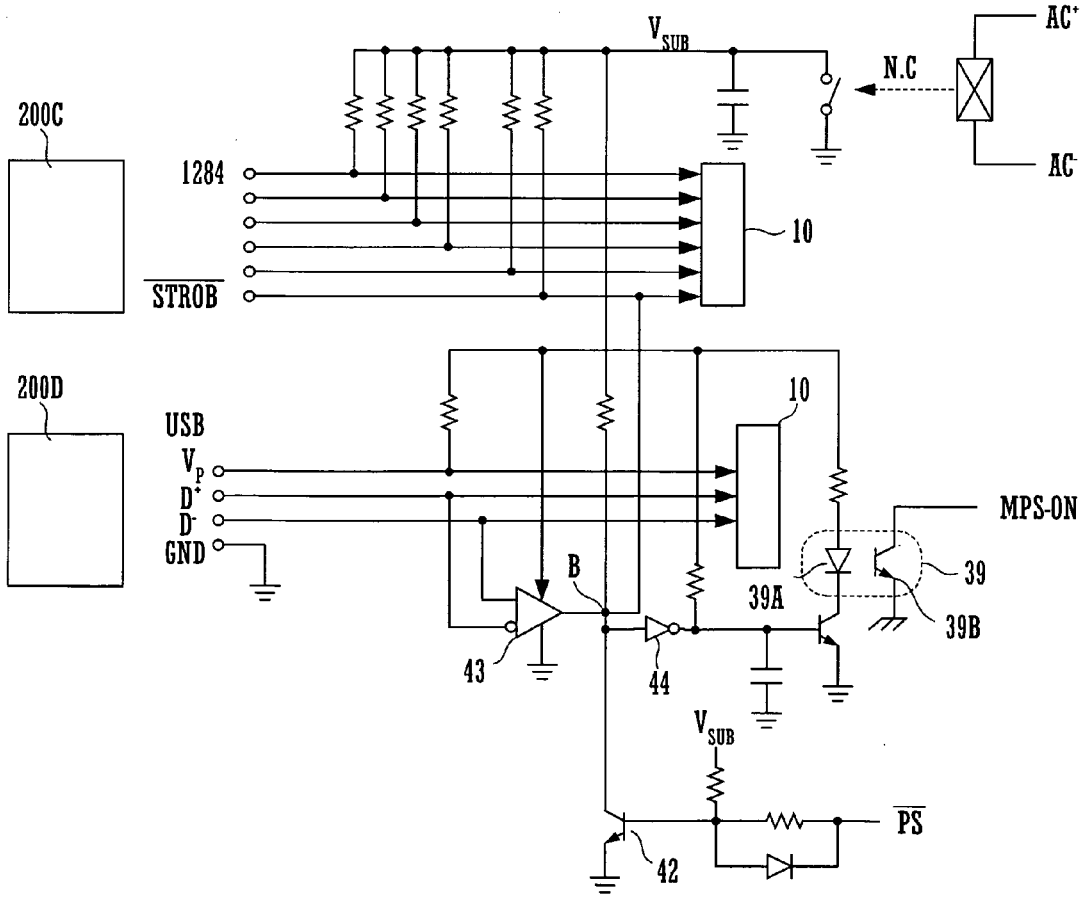

Illustrated in FIG. 5A is the ring detection circuit 31. The ring detection circuit 31 detects a FAX signal input through a public line as a start-up signal and turns the main power supply circuit 60 on. Illustrated in FIG. 5B are the 1284 signal detection circuit 33 and the USB signal detection circuit 34. The 1284 signal detection circuit 33 detects, as a start-up signal, a signal input from the external device 200C through the IEEE 1284 interface and turns the main power supply circuit 60 on. The USB signal detection circuit 34 detects, as a start-up signal, a signal input from the external device 200D through the USB interface and turns the main power supply circuit 60 on. In addition, FIG. 5B illustrates an example of configuration in which power supplied from a power supply line of the USB interface is utilized to switch the MFP 1 from the power-saving operation mode back to the normal operation mode.

As described above, input of an MPS-ON signal to the MPS signal input terminal 76 is required for turning the main power supply circuit 60 on. With a phototransistor 38B of a photocoupler 38 in nonconductive state, a high-level signal is input to the inverter 61 through the pull-up resistor 47, as shown in FIG. 4, located on an input side of the inverter 61.

At this time, with the MFP 1 in the normal operation mode, a transistor 42 is in conductive state since potential VSUB of the auxiliary power supply circuit 50 is input to a base of the transistor 42. When the transistor 42 is in conductive state, a connection point A in FIG. 5A has a low-level potential. Current is thus allowed to pass through a photodiode 38A, so that the phototransistor 38B becomes conductive. Accordingly, an MPS-ON signal is input to the MPS signal input terminal 76, thereby turning the main power supply circuit 60 on.

With the MFP 1 in the power-saving operation mode, in contrast, input of a low-level $\overline{PS}$ signal renders the transistor 42 nonconductive, thereby causing the connection point A to have a high-level potential. The phototransistor 38B thus becomes nonconductive and an MPS-ON signal is prevented from being input to the MPS signal input terminal 76. The output of the inverter 61 becomes low-level and the gate of the switching transistor 62 is forced to be grounded, so that the main power supply circuit 60 is turned off.

When detecting a predetermined FAX signal input through a public line in the power-saving operation mode, as shown in FIG. 5A, the photodiode 37A of the photocoupler 37 causes the phototransistor 37B to be conductive. The connection point A thus has a low-level potential and a buffer (open-collector) 41 is turned on, so that the phototransistor 38B of the photocoupler 38 becomes conductive. Since as a result an MPS-ON signal is input to the MPS signal input terminal 76, the main power supply circuit 60 is turned on again and the MFP 1 is switched from the power-saving operation mode back to the normal operation mode.

FIG. 5B illustrates an example of configuration in which an IEEE 1284 signal or a USB signal is detected as a start-up signal, instead of the FAX signal in FIG. 5A. The MFP is switched from the power-saving operation mode back to the normal operation mode in a similar manner in the configuration as shown in FIG. 5A.

A feature of the configuration as shown in FIG. 5B is that power supplied from a power supply line $V_P$ of the USB interface is used to turn on the main power supply circuit 60 upon detection of the start-up signal.

A $\overline{STROB}$ signal and output of a line buffer (open-collector) 43 are in wired-OR connection at a connection point B, to be input to an inverter (open-collector) 44, so that a phototransistor 39B of a photocoupler 39 becomes conductive.

The phototransistor 39B and the phototransistor 38B are in wired-OR connection. Thus, when the photo transistor 39B becomes conductive, an MPS-ON signal is input to the MPS signal input terminal 76 as in the above-described case where the transistor 38B becomes conductive. The main power supply circuit 60 is thus turned on again. Although not shown in the figure, there is an alternative configuration where power is supplied from a power supply line of another interface instead of the power supply line $V_P$ of the USB interface.

Figure 6A:
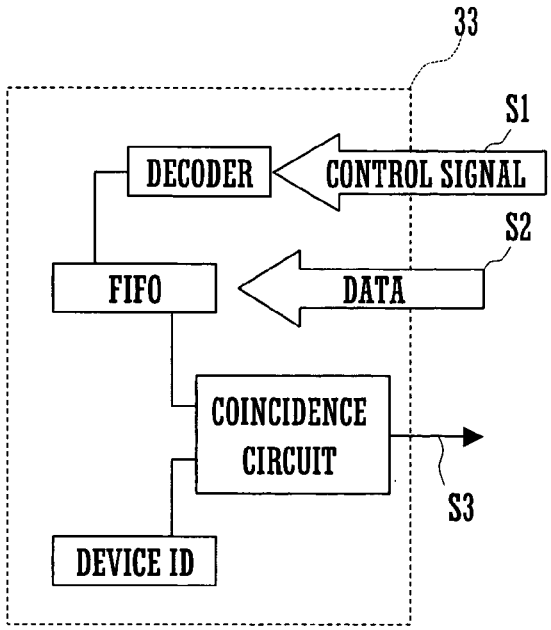
FIG. 6A and FIG. 6B are block diagrams illustrating how a device ID and an ID of a input command are recognized, respectively.
Figure 6B:
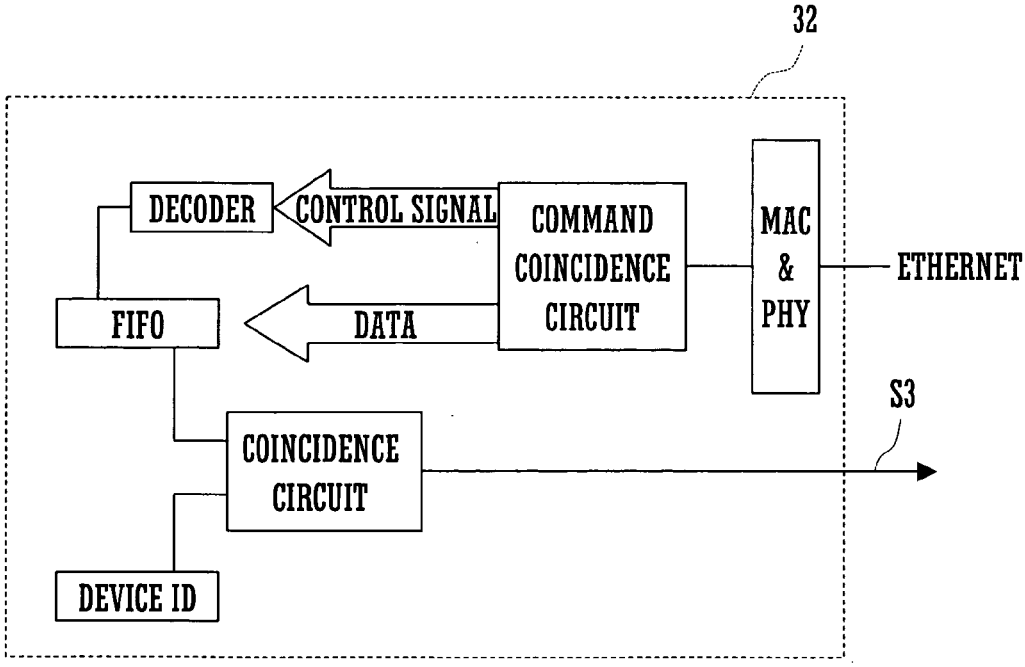

FIG. 6A shows how a device ID is recognized in the 1284 signal detection circuit 33 when a control signal S1 and data S2 are input through a Centronics interface. FIG. 6B shows how an ID of a command input through Ethernet is recognized in the LAN signal detection circuit 32.

As shown in FIGS. 6A and 6B, the 1284 signal detection circuit 33 and the LAN signal detection circuit 32 have limited functions of determining whether device ID data included in input data corresponds to pre-registered device ID data and of outputting, if the device ID data match, a start-up signal S3 to turn on the main power supply circuit 60. The limited functions allow the 1284 signal detection circuit 33 and the LAN signal detection circuit 32 to have a simplified configuration.

Figure 7:
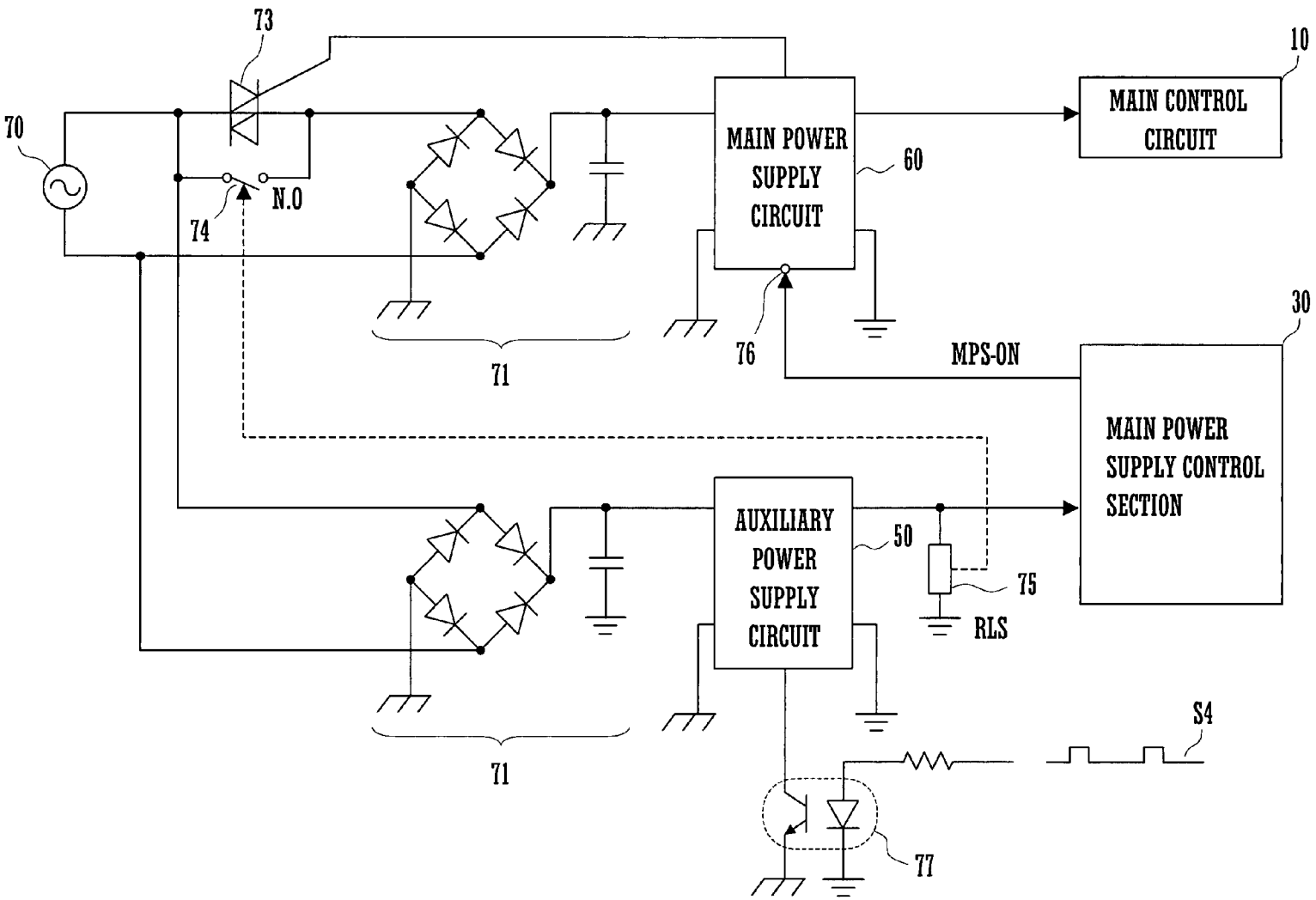
FIG. 7 is a diagram illustrating a variation of power supply circuit.
Figure 8:
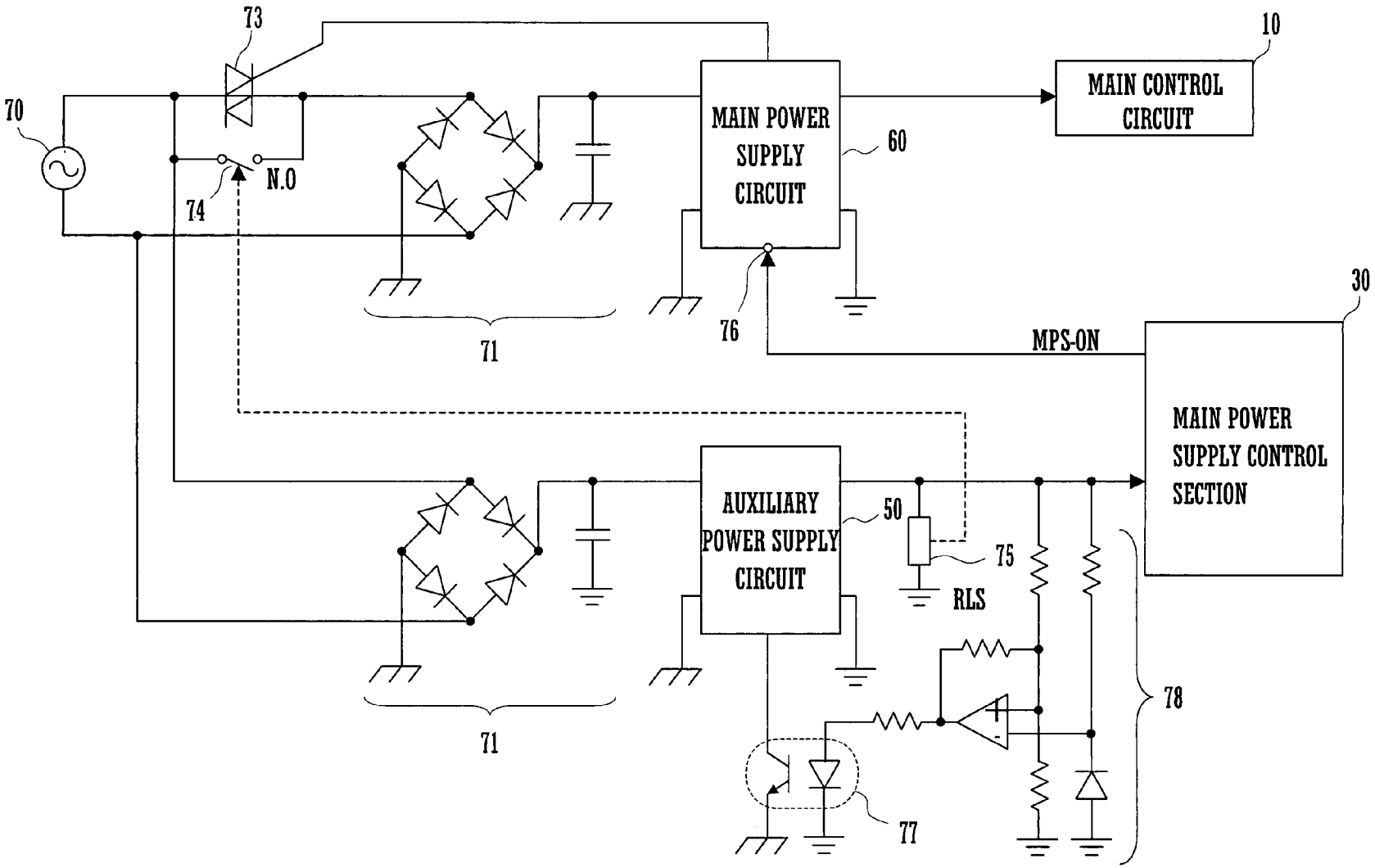
FIG. 8 is a diagram illustrating another variation of power supply circuit.

Referring to FIGS. 7 and 8, described below are variations of power supply circuit. As shown in FIG. 7, the auxiliary power supply circuit 50 is turned on/off by input of a signal S4 to a photocoupler 77, the signal S4 becoming high at predetermined intervals. The auxiliary power supply circuit 50 is thus charged by the commercial power supply 70 at predetermined intervals during the power-saving operation mode. Accordingly, even if kept in the power-saving operation mode for a long period of time, the auxiliary power supply circuit 50 can be prevented from failing to turn on the main power supply circuit 60 properly because of power shortage.

FIG. 8 shows how the auxiliary power supply circuit 50 is charged. A power supply voltage monitor circuit 78 is provided for monitoring voltage output by the auxiliary power supply circuit 50. Upon detection of output of a lower voltage than a predetermined value by the auxiliary power supply circuit 50, the power supply voltage monitor circuit 78 outputs a signal to the photocoupler 77, so that the auxiliary power supply circuit 50 is charged.

Instead of the commercial power supply 70 in the variations as described above, an interface having a power supply line may be utilized to supply power to the auxiliary power supply circuit 50. In the variation as shown in FIG. 8 where power is supplied to the auxiliary power circuit 50 at intervals, the auxiliary power supply circuit 50 does not have a shortage of power, regardless of power capacity thereof, even when kept in the power-saving operation mode for a long time.

Figure 9:
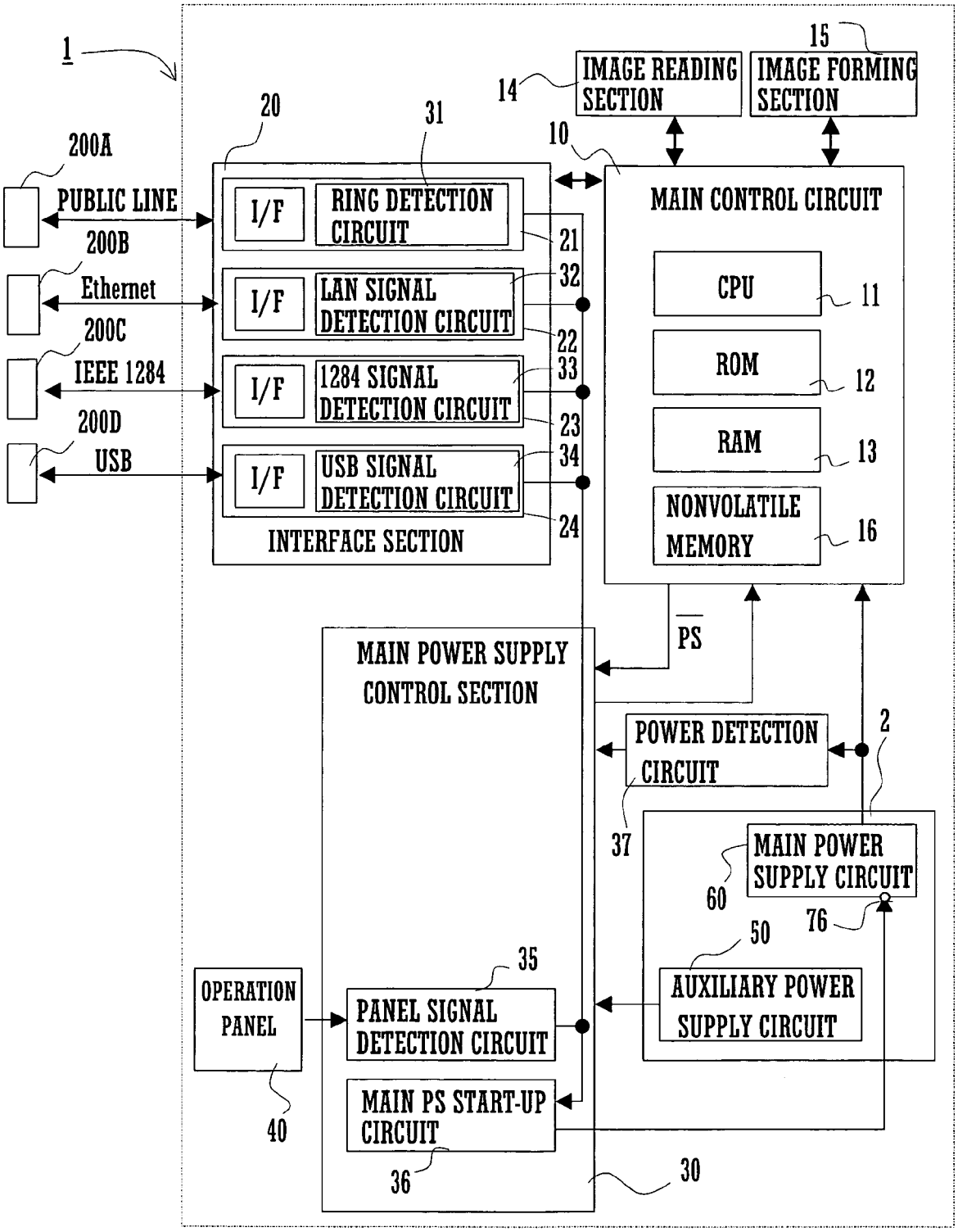
FIG. 9 is a block diagram illustrating a configuration of an image forming apparatus according to a second embodiment of the present invention.

FIG. 9 illustrates a configuration of a MFP 1 according to a second embodiment of the present invention. This embodiment is different from the first embodiment in that a ring detection circuit 31, a LAN signal detection circuit 32, a 1284 signal detection circuit 33, and a USB signal detection circuit 34 are incorporated in a FAX board 21, a LAN board 22, a printer board 23, and a USB board 24, respectively. The circuits 31 to 34 are used for detecting start-up request signals only.

The auxiliary power supply circuit 50 supplies power only to the ring detection circuit 31, the LAN signal detection circuit 32, the 1284 signal detection circuit 33, and the USB signal detection circuit 34. In the present embodiment, the ring detection circuit 31 is electrically disconnected to the other components of the FAX board 21. To the other components, the main power supply circuit 60 supplies power after being turned on.

In a data communication system including the MFP 1 and external devices 200A to 200D, the external devices 200A to 200D transmit the same piece of data to the MFP 1 multiple times. This is because of a feature of the MFP 1 that in the power-saving operation mode the MFP 1 recognizes a first input signal as a start-up signal for returning to the normal operation mode. More specifically, the MFP 1 uses the first input signal to return to the normal operation mode, and recognizes the same signal input for the second and subsequent times as communication data. In view of time required for the MFP 1 to return to the normal operation mode, the external devices 200A to 200D transmit a piece of data repeatedly to the MFP 1 until the MFP 1 returns a response confirming receipt of the piece of data.

Correspondingly, the external devices 200A to 200D recognize lack of the response as a communication error only after a predetermined number of times of sending the same piece of data. This allows smooth data communication in accordance with the foregoing feature of the MFP 1.

In addition, an interface to be used by the data communication system of the present invention is not limited to the wired interface as utilized in the foregoing embodiments, but is replaceable by a wireless interface such as Bluetooth.

Further, besides the signals input from the operation panel 40 or from the external devices 200A to 200D through the interfaces, a signal generated by insertion, of a recording medium, such as a video disk or a memory stick, into the MFP 1 may be recognized as a start-up signal.

Figure 10:
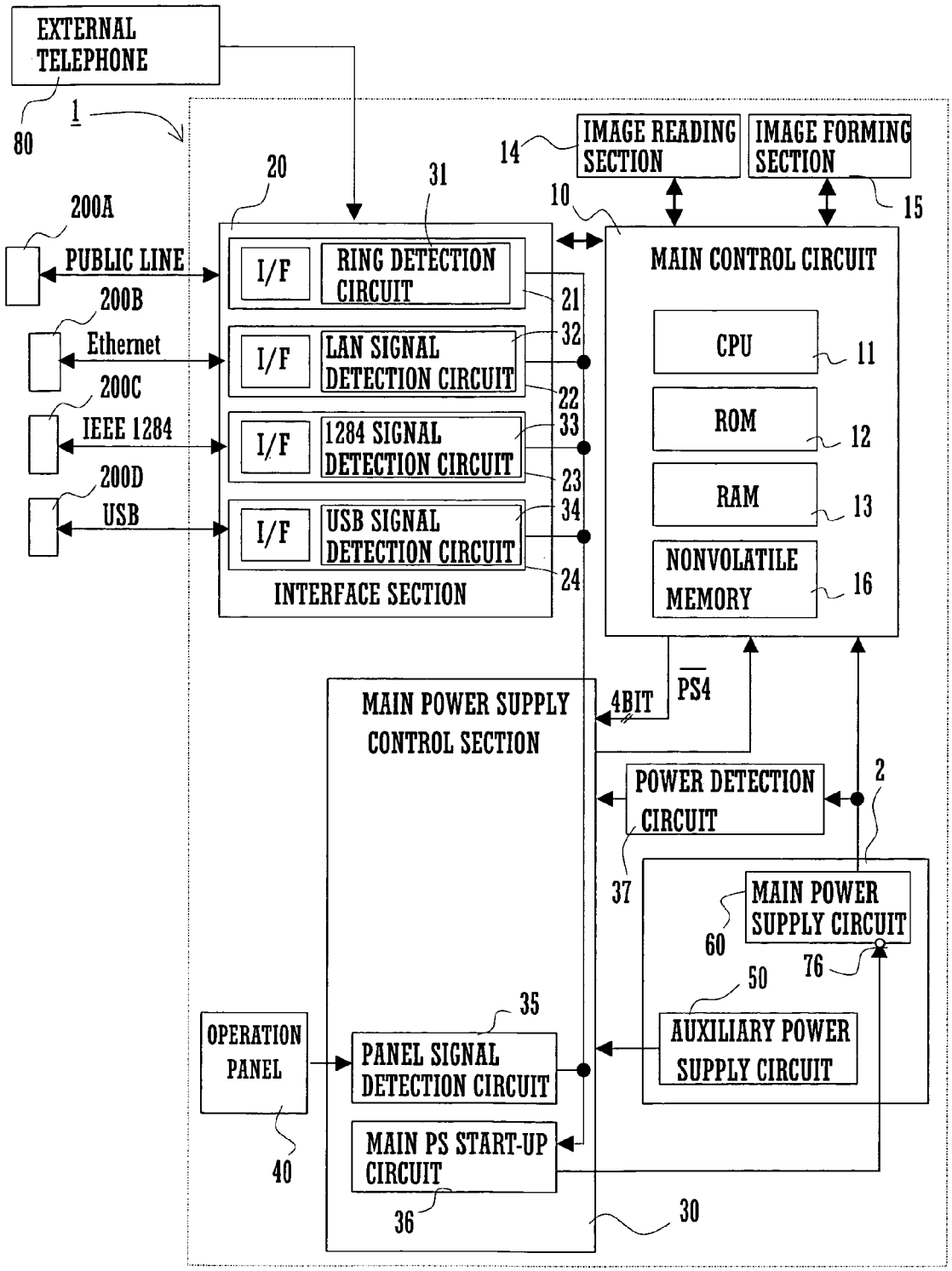
FIG. 10 is a block diagram illustrating a configuration of an image forming apparatus according to a third embodiment of the present invention.
Figure 11:
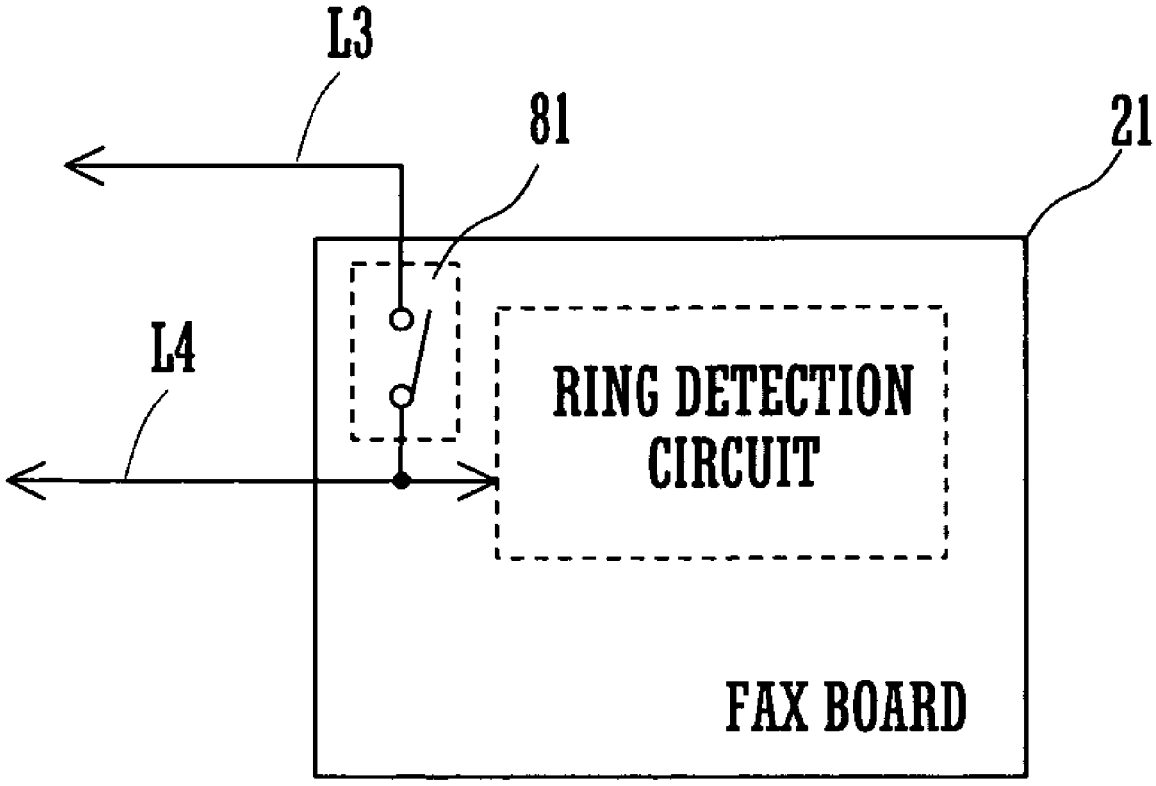
FIG. 11 is a block diagram illustrating a configuration of a FAX board in the third embodiment.

FIG. 10 illustrates a configuration of a MFP 1 according to a third embodiment of the present invention. The configuration is basically similar to that of the MFP 1 according to the second embodiment, except that the FAX board 21 has an external telephone 80 additionally connected to a telephone line through a normally closed (or N.C.) relay contact 81, as shown in FIG. 11.

In the third embodiment, the main control circuit 10 outputs a 4-bit power-save request $\overline{PS4}$ to the main power supply control section 30, instead of a power-save request $\overline{PS}$ in the first and second embodiments. If the request $\overline{PS4}$ matches a predetermined pattern of power-save request, the main power supply control section 30 generates a low-level $\overline{PS}$ signal for power-save request. If the request $\overline{PS4}$ does not match the predetermined pattern, in contrast, the main power supply control section 30 generates a high-level PS signal.

The MFP 1 in the third embodiment decides that a power-save request or a start-up request is valid when the MFP 1 confirms that the power-save request or the start-up request has been continued for a predetermined period of time. This is because decision based on detection of an edge of a power-save signal or a start-up request signal may result in false detection of such signal if the signal is overlapped with a noise.

Figure 12:
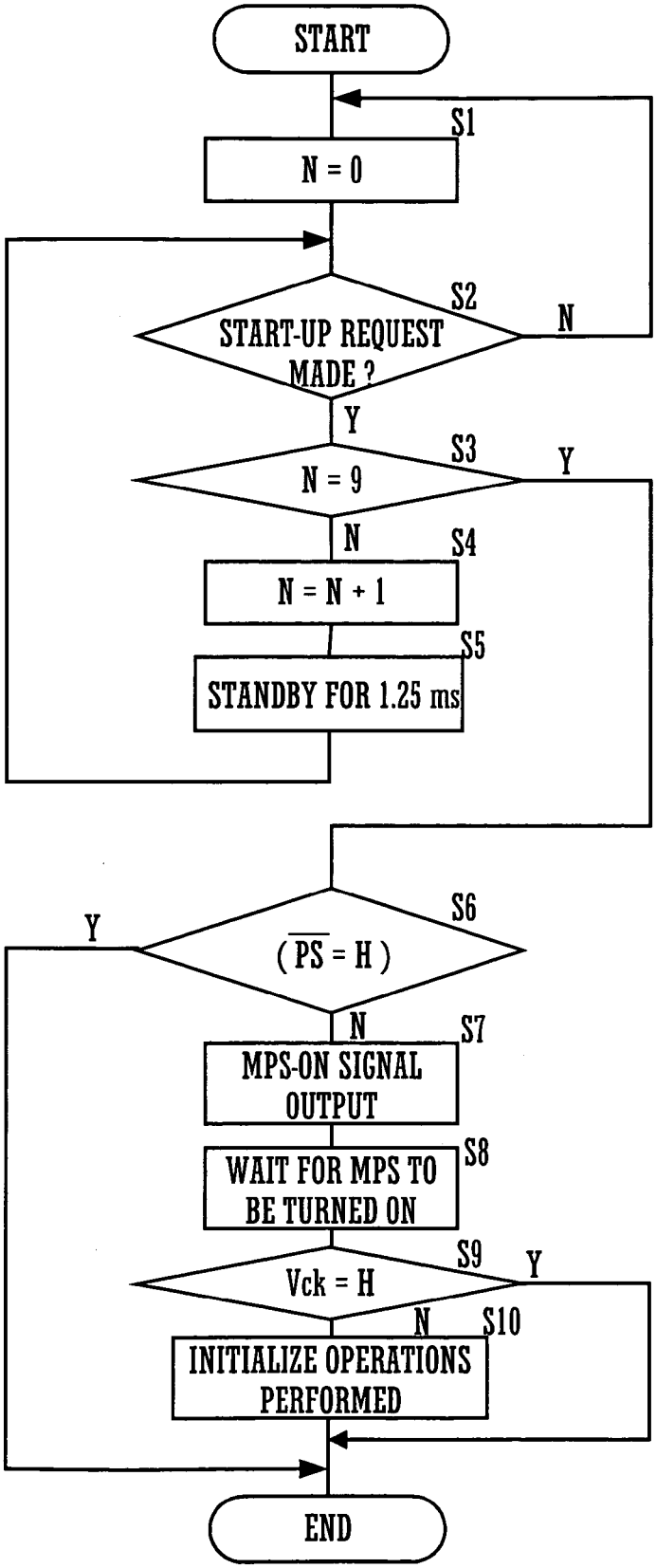
FIG. 12 is a flowchart of a process performed by the main power supply control section in returning to the normal operation mode.

FIG. 12 is a flowchart of a start-up process according to the third embodiment, performed by the main power supply control section 30. First, a count variable N for counting a period of time during which a start-up request is continued is cleared (step S1). The main power supply control section 30 is then held on standby until a start-up request is made (step S2).

When a start-up request is made at step S2, the main power supply control section 30 determines whether the count variable N has reached nine (step S3). In the present embodiment, counting is performed at intervals of 1.25 ms.

If the count variable N has not yet reached nine at step S3, the count variable N is incremented by one (step S4). After a standby period of 1.25 ms (step S5), the main power supply control section 30 determines again whether the start-up request is continued (step S2).

If the count variable N has already reached nine at step S3, the main power supply control section 30 determines whether the MFP 1 is in the power-saving operation mode (step S6). At this time, if a power-save request has been withdrawn and the MFP 1 is thus in the normal operation mode, the main power supply control section 30 stops the start-up process. If the main power supply circuit 60 is in stopped state at step S6, the main power supply control section 30 outputs a low-level start-up signal (MPS-ON signal) (step S7). Then, the main power supply control section 30 waits for the main power supply circuit 60 to be turned on (step S8), for a waiting period of 50 ms in the present embodiment. Confirming that the main power supply circuit 60 is turned on, the main control circuit 10 outputs a $\overline{PS4}$ signal that does not match the predetermined pattern of power-save request, so that a ongoing power-save request is withdrawn. Consequently, the main power supply control section 30 generates a high-level $\overline{PS}$ signal to bring the main power supply circuit 60 into operation.

At this time, the main power supply control section 30 uses the power detection circuit 37 to detect whether a voltage of 3.5 V or higher is supplied from the main power supply circuit 60 to the main control circuit 10. If the output voltage of the main power supply circuit 60 is equal to or higher than a threshold of 3.5 V, the main power supply control section 30 outputs a high-level $V_{ck}$ signal to the main control circuit 10. If the output voltage is lower than the threshold of 3.5 V, in contrast, the main power supply control section 30 outputs a low-level $V_{ck}$ signal to the main control circuit 10. In addition, the threshold is not limited to 3.5 V, but may be increased or decreased as necessary.

In starting up the main power supply circuit 60, the main control circuit 10 determines whether a $V_{ck}$ signal is high-level (step S9). If the $V_{ck}$ signal is high-level, the main power supply control section 30 ends the start-up process without the main control circuit performing the initialize operations.

If the $V_{ck}$ signal is not high, in contrast, the main control circuit 10 performs the initialize operations, and then the main power supply control section 30 ends the start-up process.

Figure 13:
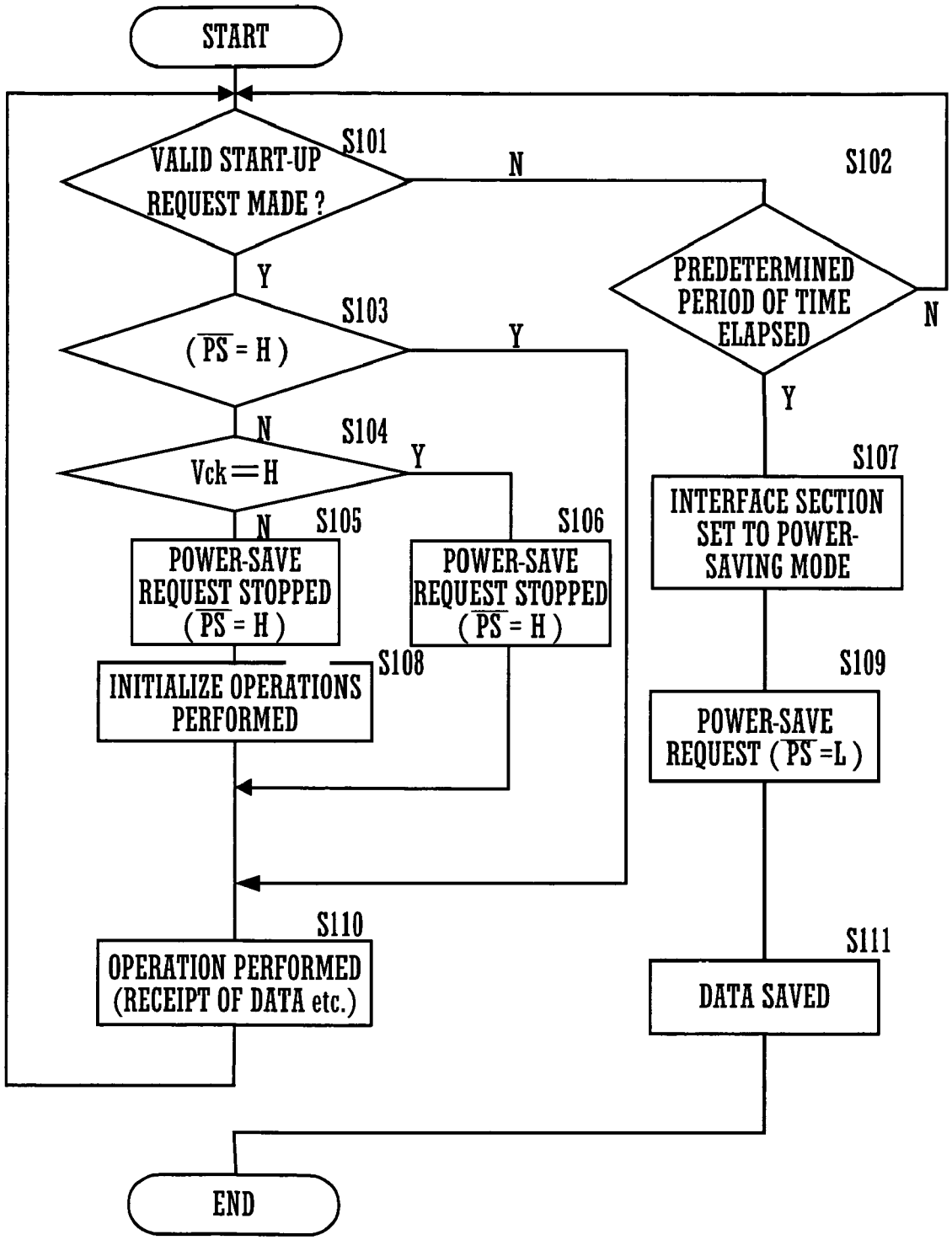
FIG. 13 is a flowchart of a process performed by the main control circuit in returning to the normal operation mode.

FIG. 13 is a flowchart of a process performed by the main control circuit 10 in returning to the normaml operation mode. The main control circuit 10 which is supplied with power by the main power supply circuit 60 is on standby until a valid start-up request is made (step S101).

When a valid start-up request is made at step S101, the main control circuit 10 determines whether a power-save request has been withdrawn, or more specifically, whether a high-level $\overline{PS}$ signal is generated (step S103).

If a high-level $\overline{PS}$ signal is generated at step S103, the main power supply circuit 60 is already turned on and the main control circuit 10 thus performs an operation according to the start-up request (step S110). Then, the main control circuit 10 proceeds to step S101.

If a high-level $\overline{PS}$ signal is not generated at step S103, the main control circuit 10 determines whether a $V_{ck}$ signal is high-level (step S104).

If a $V_{ck}$ signal is high-level at step S104, the main control circuit 10 outputs a high-level $\overline{PS}$ signal to the main power supply control section 30 to stop a power-save request (step S106). At the time, the main control circuit 10 makes the main power supply control section 30 output an MPS-ON signal to the main power supply circuit 60, by outputting a $\overline{PS4}$ signal that does not correspond to the predetermined pattern of power-save request. Then, the main control circuit 10 performs an operation according to the start-up request without performing the initialize operations (step S110). Then, the main control circuit 10 proceeds to step S101.

If a $V_{ck}$ signal is not high-level at step S104, the main control circuit 10 outputs a high-level $\overline{PS}$ signal to the main power supply control section 30 to stop a power-save request (step S105). Subsequently, the main control circuit 10 initiates the initialize operations (step S108). Then, the main control circuit 10, after waiting for a standby period of 50 ms for the main power supply control section 30 to be turned off, performs an operation according to the start-up request (step S110) and proceeds to step S101.

If a valid start-up request is not made at step S101, the main control circuit 10 determines whether a predetermined period of time has elapsed (step S102). If the predetermined period of time has not elapsed at step S102, the main control circuit 10 proceeds to step S101.

If the predetermined period of time has elapsed at step S102, the main control circuit 10 sets the interface section 20 to the power-saving operation mode, thereby stopping the operation of the interface section 20 (step S107).

Then the main control circuit 10 makes a power-save request to the main power supply control section 30 (step S109) and then saves data to a nonvolatile memory 11 immediately (step S111). In the present embodiment, the data to be saved to the nonvolatile memory 11 is data on settings of the FAX mode or the printer mode, for example. The main control circuit 10 completes the save of data before ending the process.

Figure 14:
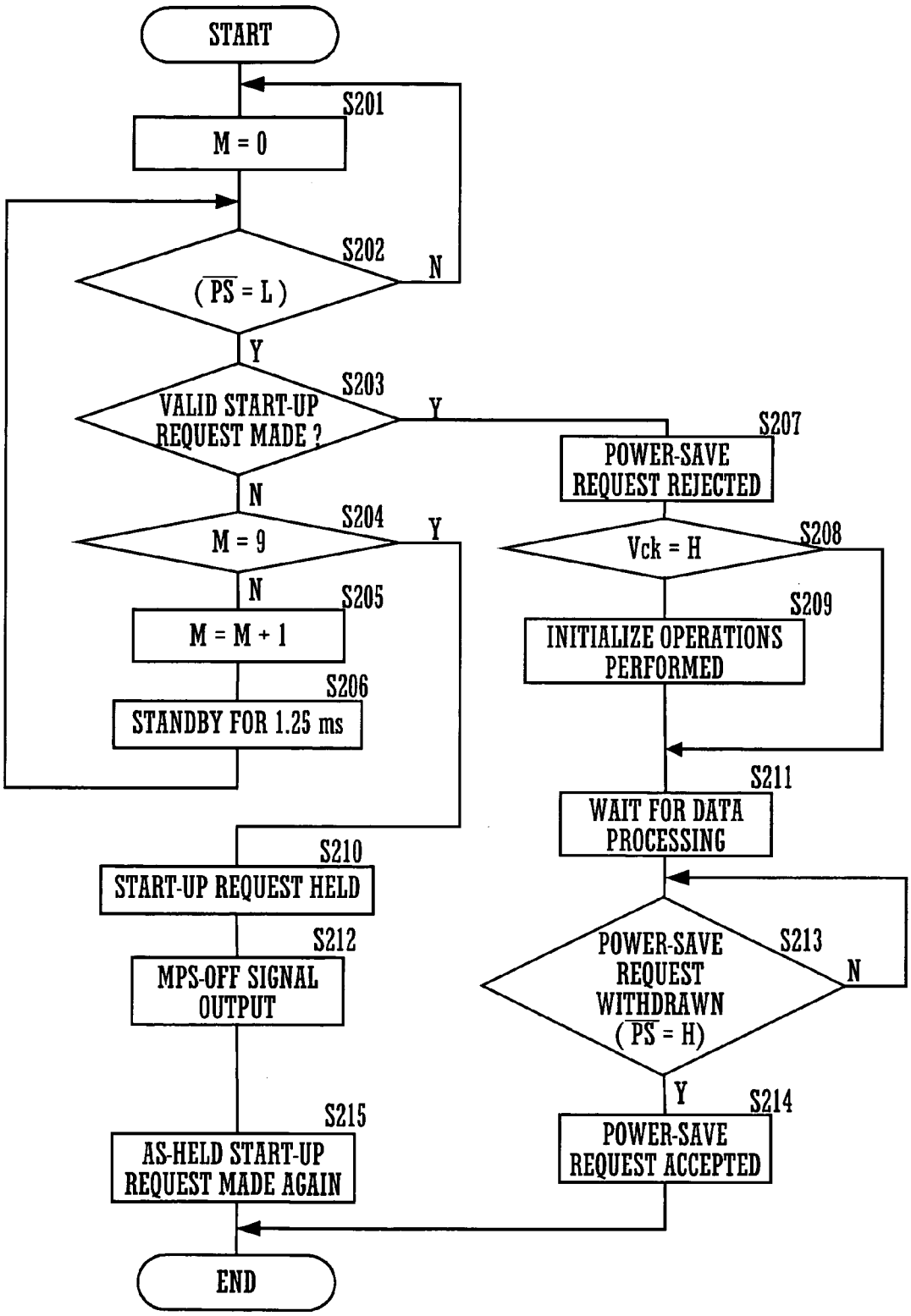
FIG. 14 is a flowchart of a process performed by the main power supply control section and the main control circuit in switching to the power-saving operation mode.

FIG. 14 is a flowchart of a process performed by the main control circuit 10 and the main power supply control section 30 when a power-save request is made in the normal operation mode. The main power supply control section 30 clears a count variable M to zero (step S201) and then stands by until a power-save request is made (step S202). At step S202, the main power supply control section 30 waits for a $\overline{PS4}$ signal that corresponds to the predetermined pattern of power-save request, to be input thereto.

If a valid power-save request $\overline{PS4}$ is made at step S202, the main power supply control section 30 detects whether the power-save request is followed by a valid start-up request (step S203).

When a valid start-up request is not made at step S203, the main power supply control section 30 determines whether the count variable M has reached nine (step S204). If the count variable M has not reached nine, the main power supply control section 30 increments the count variable M (step S205), stands by for a period of 1.25 ms (step S206), and determines whether the power-save request is continued (step S202). More specifically, in the sequence of steps S204, S205, S206, and S202 and in step S201, the main power supply control section 30 checks for a situation in which a 4-bit $\overline{PS4}$ signal being input does not correspond to the predetermined pattern of power-save request, such as a situation in which a power-save request is withdrawn from the main control circuit 10 before the power-save request is continued for a period of 10 ms.

If the count variable M has reached nine at step S204, the main power supply control section 30 holds a start-up request (step S210). Then the main power supply control section 30 changes a low-level MPS-ON signal to a high-level MPS-OFF signal to turn off the main power supply circuit 60 (step S212). Subsequently, the main power supply control section 30 stands by until the main power supply circuit 60 is turned off completely. In the present embodiment, it takes approximately 100 ms for the main power supply circuit 60 to be turned off completely. If a valid start-up request is made after the start-up request is held at step S210, the main power supply control section 30 makes the as-held start-up request again (step S215), and then ends the operation.

Once a valid start-up request is made at step S203, where detection is made as to whether a power-save request is followed by a valid start-up request, the main power supply control section 30 rejects any power-save request to prevent unnecessary switching to the power-save operation mode (step S207).

Then the main control circuit 10 determines whether a $V_{ck}$ signal is high-level (step S208). If the $V_{ck}$ signal is high-level at step S208, the main control circuit 10 immediately performs an operation according to the start-up request without performing the initialize operations, and waits for completion of data processing in accordance with the start-up request (step S211).

If the $V_{ck}$ signal is not high-level at step S208, in contrast, the main control circuit 10 performs the initialize operations and then an operation according to the start-up request, and waits for completion of data processing in accordance with the start-up request (step S211).

The main power supply control section 30 stands by until the power-save request is withdrawn by the main control circuit 10 that has made the power-save request (step S213).

Confirming that the power-save request has been withdrawn by the main control circuit 10, the main power supply control section 30 cancels the rejection of power-save request, thereby being ready to accept a power-save request (step S214).

In the foregoing embodiments, the main control circuit 10 stops communication operations of the interface section 20 during a period between the start of switching to the power-save operation mode and the completion of the switching. This prevents potential malfunction of the interface section 20 when the operation modes are switched. Besides, there is a possible option of the main control circuit 10 stopping the operations of the interface section 20 immediately after detecting that the MFP 1 is turned off. This prevents potential malfunction of the interface section 20 when the MFP 1 is turned off.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

a control section for setting an operation mode of the apparatus to either a normal operation mode or a power-saving operation mode;

a main power supply circuit for supplying power to the control section in the normal operation mode;

an auxiliary power supply circuit for supplying power to the control section in the power-saving operation mode; and a detection circuit for detecting a state of power supply from the main power supply circuit to the control section, wherein the control section immediately initiates an operation according to a start-up request without setting the operation mode of the apparatus to the power-saving operation mode, if a power-save request is followed by the start-up request and an amount of power detected by the detection circuit is greater than a predetermined value.

2. An image forming apparatus according to claim 1, further comprising:

a signal detection circuit for detecting an external input signal; and an interface section for controlling data communication with an external device, wherein the control section stops communication operations of the interface section during a period between the start of switching to the power-saving operation mode and the completion of the switching.

3. An image forming apparatus according to claim 1, wherein the control section stops the communication operations of the interface section when detecting that the apparatus is turned off.

4. An image forming apparatus according to claim 1, wherein the control section saves data on settings of the apparatus to a nonvolatile memory during a period between the start of switching to the power-saving operation mode and the completion of the switching.

5. An image forming apparatus according to claim 1, wherein the auxiliary power supply circuit supplies power only to the signal detection circuit in the power-saving operation mode.

6. An image forming apparatus according to claim 1, wherein the detection circuit is adapted to detect an amount of voltage supplied from the main power supply circuit to the control section.

7. An image forming apparatus comprising:

a control section for setting an operation mode of the apparatus to a normal operation mode or a power-saving operation mode;

a main power supply circuit for supplying power to the control section in the normal operation mode;

an auxiliary power supply circuit for supplying power to the control section in the power-saving operation mode; and a detection circuit for detecting a state of power supply from the main power supply circuit to the control section, wherein the control section initiates an operation for switching the operation mode from the normal operation mode to the power-saving operation mode in response to a power-save request and, if a start-up request is received after the initiation of the operation and an amount of power detected by the detection circuit is greater than a predetermined value, the control section stops the operation and switches to the normal operation mode without entering the power-saving operation mode.

8. An image forming apparatus according to claim 7, further comprising:

a signal detection circuit for detecting an external input signal; and an interface section for controlling data communication with an external device, wherein the control section stops communication operations of the interface section during the operation.

9. An image forming apparatus according to claim 7, wherein the control section saves data on settings of the apparatus to a nonvolatile memory during the operation.

10. An image forming apparatus according to claim 7, wherein the auxiliary power supply circuit supplies power only to the signal detection circuit in the power-saving operation mode.

11. An image forming apparatus according to claim 7, wherein the detection circuit is adapted to detect an amount of voltage supplied from the main power supply circuit to the control section.

12. An image forming apparatus comprising:

a control section for setting an operation mode of the apparatus to a normal operation mode or a power-saving operation mode;

a main power supply circuit for supplying power to the control section in the normal operation mode;

an auxiliary power supply circuit for supplying power to the control section in the power-saving operation mode; and a detection circuit for detecting a state of power supply from the main power supply circuit to the control section, wherein:

the control section performs a first operation for switching the operation mode from the normal operation mode to the power-saving operation mode in response to a power-save request;

the control section performs a second operation and initialization steps for switching the operation mode from the power-saving operation mode to the normal operation mode in response to a start-up request; and if a start-up request is received during the first operation and an amount of power detected by the detection circuit is greater than a predetermined value, the control section performs the second operation, without initialization steps, for switching the operation mode to the normal operation mode.

13. An image forming apparatus according to claim 12, further comprising:

a signal detection circuit for detecting an external input signal; and an interface section for controlling data communication with an external device, wherein the control section stops communication operations of the interface section during the first operation.

14. An image forming apparatus according to claim 12, wherein the control section saves data on settings of the apparatus to a nonvolatile memory during the first operation.

15. An image forming apparatus according to claim 12, wherein the auxiliary power supply circuit supplies power only to the signal detection circuit in the power-saving operation mode.

16. An image forming apparatus according to claim 12, wherein the detection circuit is adapted to detect an amount of voltage supplied from the main power supply circuit to the control section.

* * * * *